US006024433A

United States Patent [19]

Tsurui et al.

[11] Patent Number: 6,024,433

[45] Date of Patent: Feb. 15, 2000

[54] INK JET RECORDING DEVICE

[75] Inventors: Kohji Tsurui, Sakurai; Hiroshi Kubota, Yamatotakada; Hisashi Yoshimura, Nara; Kazuya Koyama, Ikoma; Norihiro Ochi, Yamatokoriyama; Yoshio Kanayama, Nabari, all of Japan

[73] Assignee: Sharp Kabushiki Kaisha, Osaka, Japan

[21] Appl. No.: 08/533,346

[22] Filed: Sep. 25, 1995

[30] Foreign Application Priority Data

Sep. 30, 1994 [JP] Japan ..... 6-237583

[51] Int. Cl.[7] ..... B41J 2/165; B41J 2/175

[52] U.S. Cl. ..... 347/26; 347/88

[58] Field of Search ..... 347/26, 30, 36, 347/88, 85, 17, 16; 417/477.1

[56] References Cited

U.S. PATENT DOCUMENTS

| | | | |
|---|---|---|---|
| 4,164,745 | 8/1979 | Cielo et al. | 347/26 |
| 4,870,431 | 9/1989 | Sousa et al. | 347/25 |
| 5,418,561 | 5/1995 | Fujioka | 347/88 |
| 5,486,854 | 1/1996 | Uchida | 347/30 |
| 5,489,925 | 2/1996 | Brooks et al. | 347/85 |
| 5,621,444 | 4/1997 | Beeson | 347/88 |

FOREIGN PATENT DOCUMENTS

| | | | |
|---|---|---|---|
| 574268 | 12/1993 | European Pat. Off. . | |
| 55-54368 | 4/1980 | Japan | 347/88 |
| 4-133750 | 5/1992 | Japan . | |

OTHER PUBLICATIONS

Japanese Publication No. JP3275359, *Patent Abstracts of Japan,* vol. 16, No. 94, Mar. 9, 1992.

Japanese Publication No. JP6340080, *Patent Abstracts of Japan,* Vo. 95, No. 3, Apr. 28, 1995.

*Primary Examiner*—N. Le

*Assistant Examiner*—Thien Tran

[57] ABSTRACT

An ink jet recording device has heating device for heating ink at a suction pipe, a suction pump or a cap member. With this structure, an unsatisfactory operation of the ink jet recording device due to coagulation of ink can be prevented even when heat melting ink, or ink presenting plastic-flowability at the ordinary temperature, is used for the ink jet recording device.

2 Claims, 7 Drawing Sheets

INK JET RECORDING DEVICE

BACKGROUND OF THE INVENTION

1. Field of the Invention

The present invention relates to a structure of an ink jet recording device provided with a maintenance device for sucking ink drops, dust etc. stagnating in a recording head in order to recover from unsatisfactory ink jet using heat melting ink or ink which presents plastic-flowability at the ordinary temperature.

2. Description of the Background Art

An ink jet recording device of ink jet method where recording is performed by jetting ink drops from a plurality of ink jet outlets onto recording paper is widely used for a printer, facsimile, word processor etc. A recording head for the ink jet recording device includes those performing black-and-white printing and color printing which is adapted to accommodate ink of different colors. An example of a conventional jet recording device is disclosed, for example, in Japanese Patent Laying-Open No. 4-133750.

FIG. 7 is a schematic perspective view illustrating a structure of the ink recording device. A carriage 63 is provided such that carriage 63 can reciprocate along a guide shaft 61 by a driving belt 62. On carriage 63, a recording head 65 which is provided with an ink tank 64 is mounted. Recording head 65 performs printing on recording paper 67 which is carried to the front side of a platen roller 66.

A wiping blade 68 suitably abuts against recording head 65 and removes ink drops and dust adhering to recording head 65.

A cap 69 seals recording head 65 in a manner that head 65 is covered with cap 69 in order to protect head 65 when printing by head 65 is not performed, and sucks ink drops and dust stagnating in head 65 using a suction pump within a suction unit 71 which is connected to cap 69 via a suction pipe 70 when printing is unsatisfactorily performed. The ink drops and dust which are sucked by suction unit 71 are collected in waste ink unit 73. This recovers printing performance of recording head 65.

Now FIG. 8 is a schematic diagram illustrating the internal structure of suction unit 71. A suction pump 72, referred to as a tube pump, is provided in suction unit 71. A plurality of rollers 76*a*, 76*b*, 76*c* are rotatably attached to suction pump 72 around a rotor 75 which is driven by a motor. Each of rollers 76*a*, 76*b*, 76*c* can rotate about its center as a rotation axis.

A tube 78 which deforms elastically is provided between a pump case 72A and rotor 75. With rotor 75 rotating in the direction of the arrows shown in the figure, rollers 76*a*, 76*b*, 76*c* rotate while pressing against tube 78. This will generate negative pressure on the side of cap 69, and ink drops and dust are sucked from recording head 65 abutting against cap 69. The ink drops and other wastes sucked by suction pump 72 pass through from a tube 78*a* to a tube 78*b*, are sent to a waste ink unit 73 and collected there.

In the ink jet recording device described above, if ink within a nozzle of the recording head is mixed with air bubbles, dust, etc., ink jet at the recording head would be unsatisfactory. The unsatisfactory ink jet causes missing and displacement of printing dots. This causes the problem that quality of printing by the recording head will deteriorate.

In order to solve this problem, means have been taken for recovering printing performance of the recording head, by covering cap 69 with recording head 75 and sucking the recording head using a suction pump communicated with cap 69, so that air bubbles and dust can be sucked together with ink drops within recording head 75.

On the other hand, when heat melting ink is used for the ink jet recording device, high quality printing can be achieved, since the ink drops on recording paper bleed only to a small extent.

When heat melting ink is used in the ink jet recording device, the heat melting ink will be cooled and coagulate within the suction pipe while the head is being sucked if the head is sucked using a conventional suction unit. As a result, the suction pipe will be clogged and the ink drops cannot be sucked.

Furthermore, even if heat melting ink is sucked successfully, the heat melting ink which remains within the suction pump will be cooled and coagulate. As a result, the problem arises that the rotor and rollers within the suction pump will be stuck and that the suction pump cannot be used.

In other words, in the ink jet recording device using heat melting ink which is solid at the ordinary temperature and is heated for use, or ink which presents plastic-flowability at the ordinary temperature and is heated for use in printing, there has been a problem that the performance of the suction unit will deteriorate.

SUMMARY OF THE INVENTION

An object of the present invention is to provide an ink jet recording device provided with a maintenance device which can prevent coagulation of ink in a suction unit even when heat melting ink or ink presenting plastic-flowability at the ordinary temperature is used as recording ink.

In order to achieve the above object, the ink jet recording device of the present invention is provided with a cap member for covering a jet portion which jets ink of a recording head; a waste ink tank for collecting waste ink; an ink suction pipe connecting the cap member with the waste ink tank for sucking and draining out waste ink adhering to the recording head; and a suction device connected to the ink suction pipe; wherein the suction pipe is provided with a heating device for heating the waste ink.

According to the structure with the suction pipe being provided with the heating device, even when ink presenting solidity or plastic-flowability at the ordinary temperature is used for the ink jet recording device, the heating device will heat the ink up and make the ink flow easily, so that the ink can be sucked, never clogging the suction pipe. Also, an unsatisfactory operation of the suction unit due to the clog of the suction pipe with ink can be prevented. Furthermore, if the ink which was sucked previously presents plastic-flowability at the time of power-on of the suction unit, the ink can be fluidized and sucked by heating the suction pipe with the heating device. As a result, high accuracy of performance of the suction unit can be always maintained.

Furthermore, a heater line is preferably provided within the suction pipe as the heating device for the suction pipe.

This allows heat to be efficiently transferred to the ink within the suction pipe if the suction pipe is made of a material of a low heat conductivity. Furthermore, melting rate of the ink can be accelerated by providing the heater line helically within the suction pipe and increasing the contact area of the heater line with the ink. Furthermore, if the thickness of the suction pipe is thin, the helix heater line could prevent the suction pipe from being broken due to negative pressure generated by the suction pump.

Still preferably, the suction pipe is made of metal and provided with the heating device on the circumference of the suction pipe. According to this structure with the suction pipe made of metal, the conductivity of the suction pipe will be improved. Accordingly, the suction pipe can be externally heated efficiently. Also, if a heater is provided at a portion of the suction pipe, the entire suction pipe will be heated rapidly, allowing for miniaturization of the heating device.

According to another aspect of the ink jet recording device of the present invention for achieving the object described above, the ink jet recording device is provided with a cap member for covering a jet portion which jets ink of a recording head; a waste ink tank for collecting waste ink; an ink suction pipe connecting the cap with the waste ink tank for sucking and removing waste ink adhering to the recording head; and a suction device connected to the ink suction pipe; wherein the suction device is provided with a heating device for heating the waste ink.

According to the structure with the suction device being provided with the heating device, even in the case of ink presenting solidity or plastic-flowability at the ordinary temperature, the heating device will heat the waste ink up and make the ink flow easily. As a result, the waste ink can be sucked without the suction pipe being clogged. Also, an unsatisfactory operation of the suction unit due to the clog of the suction device with ink can be prevented. Furthermore, if the ink which was sucked previously is solid or presents plastic-flowability at the time of power-on of the suction unit, the ink can be fluidized and then sucked by heating the suction device, and high accuracy of performance of the suction unit can be always maintained.

Still preferably, the suction device is a tube pump provided with a pipe member part of which is formed of elastic body, and with a pressurizing roller which produces negative pressure in the pipe member by pressurizing the pipe member externally while moving the pressurized portion.

Accordingly, since the pipe member and the pressurizing roller are separated completely, infiltration of the ink into the pressurizing roller portion can be avoided, thereby preventing an unsatisfactory operation of the suction pipe due to the infiltration of the ink into the pressurizing roller portion.

Still preferably, the tube pump has ring-shaped heating device a heat source of which is an infra-red lamp. This allows the heating device to heat the pipe member and the pressurizing roller without contacting the pressurizing roller portion of the tube pump, and therefore the damage of the heating device due to an action of the suction pump can be prevented.

According to another aspect of the ink jet recording device of the present invention for achieving the object described above, the ink jet recording device is provided with a cap member for covering a jet portion which jets ink of a recording head; a waste ink tank for collecting waste ink; an ink suction pipe connecting the cap member with the waste ink tank for sucking and draining out waste ink adhering to the recording head; and a suction device connected to the ink suction pipe; wherein the cap member is provided with a heating device for heating the waste ink.

According to the structure with the cap member being provided with the heating device, even when ink presenting solidity or plastic-flowability at the ordinary temperature is used for the ink jet recording device, the ink will be heated by the heating device and be made to flow easily. Accordingly, the ink can be sucked without stagnating around the cap member, so that an unsatisfactory operation of the suction unit due to the clog of the cap member with ink can be prevented. Furthermore, if waste ink sucked previously presents solidity or plastic-flowability in the cap member at the time of power-on of the suction unit, the waste ink can be fluidized and then sucked by heating the cap member, and high accuracy of performance of the suction unit can be always maintained.

Still preferably, the heating device is provided in a carriage on which the recording head is mounted, and the heating device heats the cap member with the recording head in contact with the cap member.

Thus, the cap member can be heated without providing the heating device in the cap member itself.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
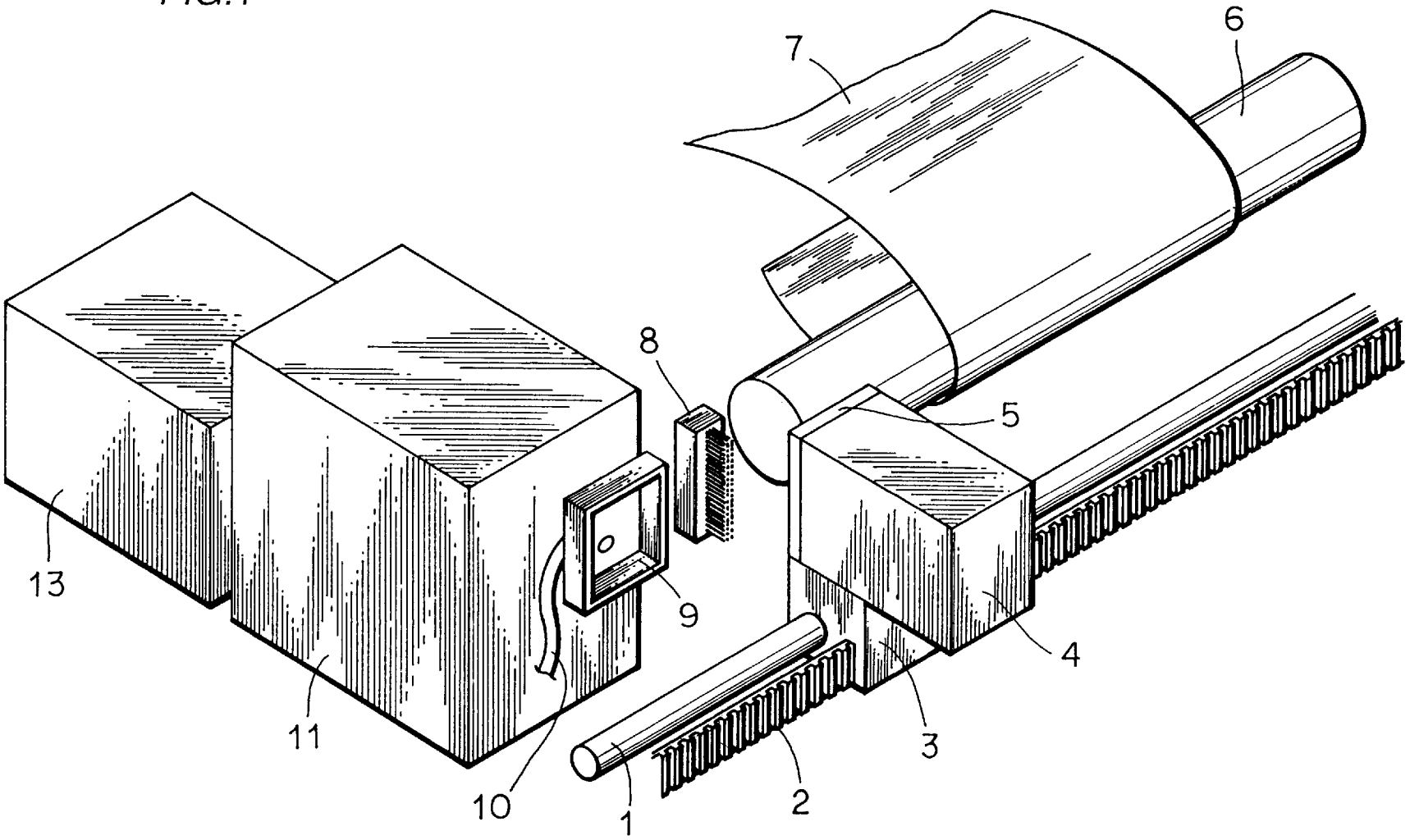
FIG. 1 is a schematic view of the structure of the ink jet recording device in accordance with the present invention.
Figure 2:
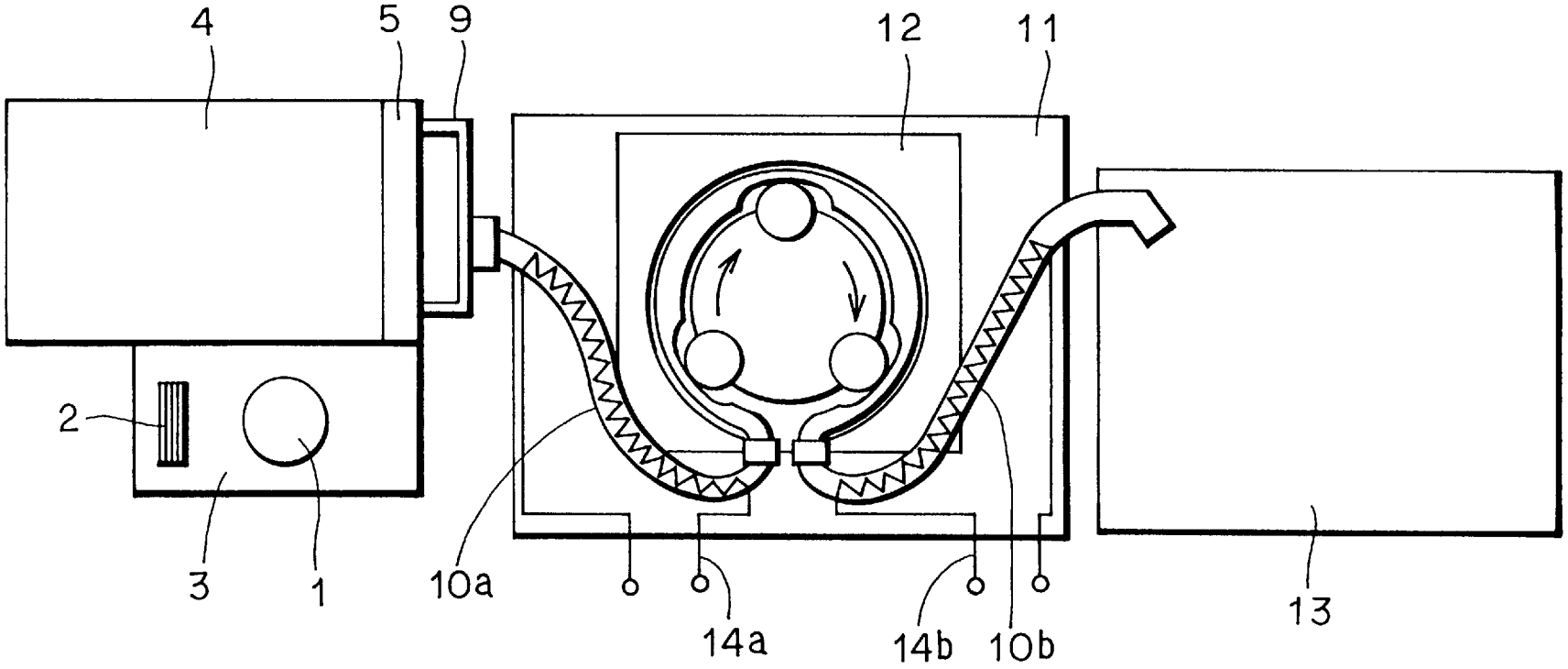
FIG. 2 is a diagram showing a first embodiment in which the suction pipe is provided with the heating device.

Hereinafter a first embodiment of the ink jet recording device in accordance with the present invention will be described with reference to FIGS. 1 and 2.

First, referring to FIG. 1, the outline of the ink jet recording device of the first embodiment will be described. A carriage 3 can reciprocate along a guide shaft 1 by a driving belt 2. On carriage 3, a recording head 5 which is provided with an ink tank 4 is mounted. Recording head 5 performs printing on a sheet of recording paper 7 which is carried to the front side of a platen roller 6. A wiping blade 8 abuts against recording head 5 as required and removes ink drops and dust adhering to recording head 5.

A cap 9 seals and protects recording head 5 when printing by head 5 on printing paper 7 is not performed, and sucks the drops and dust within head 5 using a suction pump within a suction unit 11 which is connected to cap 9 via a suction pipe 10 when printing is performed unsatisfactorily. This recovers printing performance of recording head 5. The ink sucked by the suction pump using the cap 9 is collected in a waste ink unit 13 connected to suction unit 11.

Now, referring to FIG. 2, the structure of a suction pump 12 provided within suction unit 11 will be described. Suction pump 12 is connected between suction pipes 10*a* and 10*b*. One end of suction pipe 10*a* is connected to cap 9 and one end of suction pipe 10*b* is connected to waste ink unit 13. The principle of operation of suction pump 12 is not repeated here, since it is the same as that of the suction pump described with reference to FIG. 8.

Heater lines 14*a*, 14*b* are inserted within suction pipes 10*a*, 10*b* and are connected to an external power supply source.

Thus, by providing heater lines 14*a*, 14*b* directly inside suction pipes 10*a*, 10*b*, even ink presenting solidity or plastic-flowability at the ordinary temperature is heated by the heater lines, so that the ink can always flows easily. As a result, ink can be sucked without clogging suction pipe 10*a*, 10*b* with ink, so that an unsatisfactory operation of suction unit 11 due to the clogged suction pipes 10*a*, 10*b* can be prevented. Furthermore, the amount of ink in contact with the heater lines is increased as the heater lines are provided helically within the suction pipe so that melting temperature of the ink can be increased. Also the spiral heater lines can prevent the suction pipes from being damaged due to negative pressure caused by the suction pump. Furthermore, even when a suction pipe made of resin with low heat conductivity is used, heat can be transferred to the ink efficiently since the heater lines are provided directly within the suction pipe.

Second Embodiment

Figure 3:
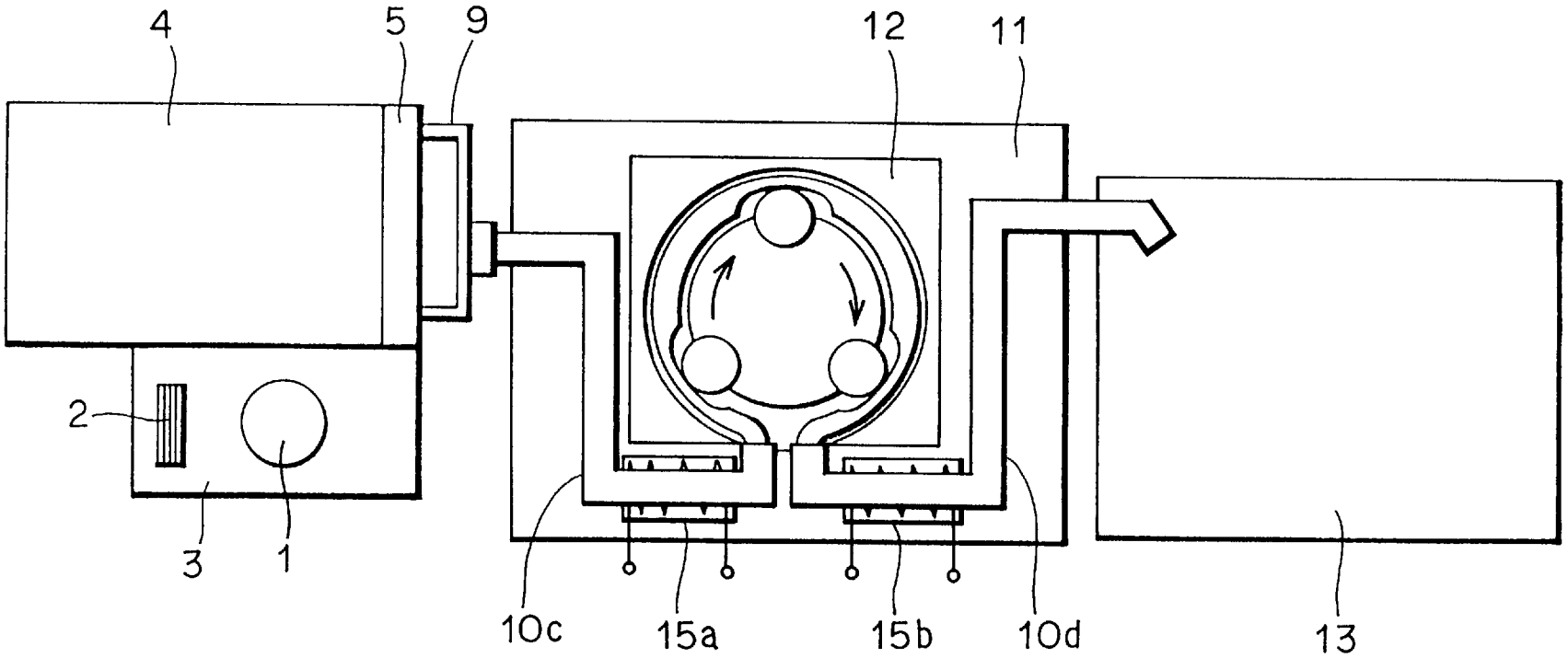
FIG. 3 is a diagram showing a second embodiment in which the suction pipe is provided with the heating device.

A second embodiment in accordance with the present invention will now be described with reference to FIG. 3. While suction pipes 10*a*, 10*b* in the first embodiment are provided with the heater lines, a suction pipe made of metal such as stainless steel is used for suction pipes 10*c*, 10*d* in the ink jet reading device of the second embodiment. Furthermore, suction pipes 10*c*, 10*d* made of stainless steel are provided with external heating devices 15*a*, 15*b* for heating suction pipes 10*c*, 10*d*.

Thus, it is not necessary to heat up the entire suction pipes by utilizing stainless steel which is a metal having good heat conductivity, and therefore the entire pipes can be heated sufficiently by providing the heating devices only at a portion of the suction pipes. This allows miniaturization of the heating devices and therefore of suction unit 11.

Third Embodiment

Figure 4:
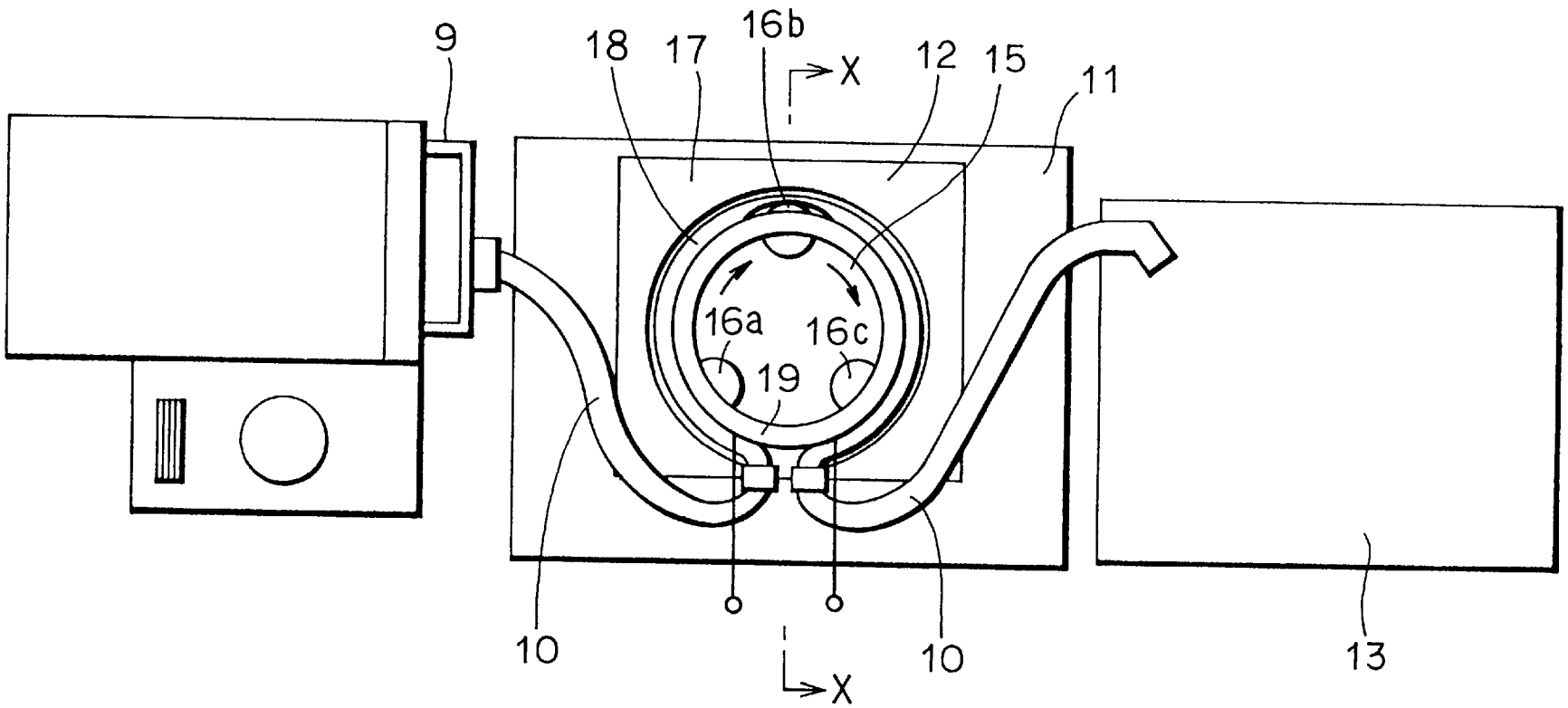
FIG. 4 is a diagram showing a third embodiment in which the suction pipe is provided with the heating device.
Figure 5:
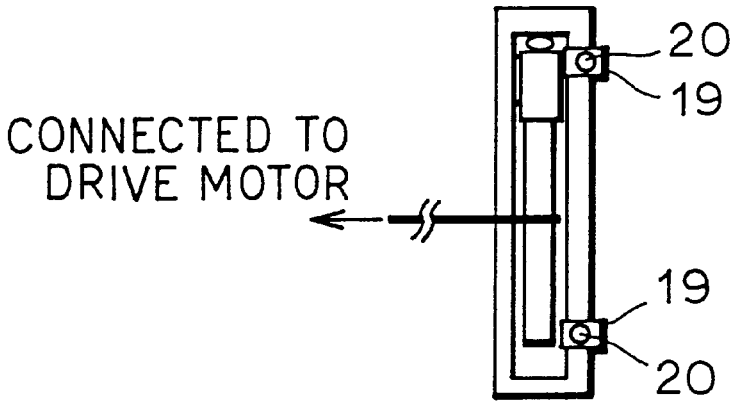
FIG. 5 is a cross sectional view taken along the line X—X in FIG. 4.

A third embodiment according to the present invention will be now described with reference to FIGS. 4 and 5.

Figure 8:
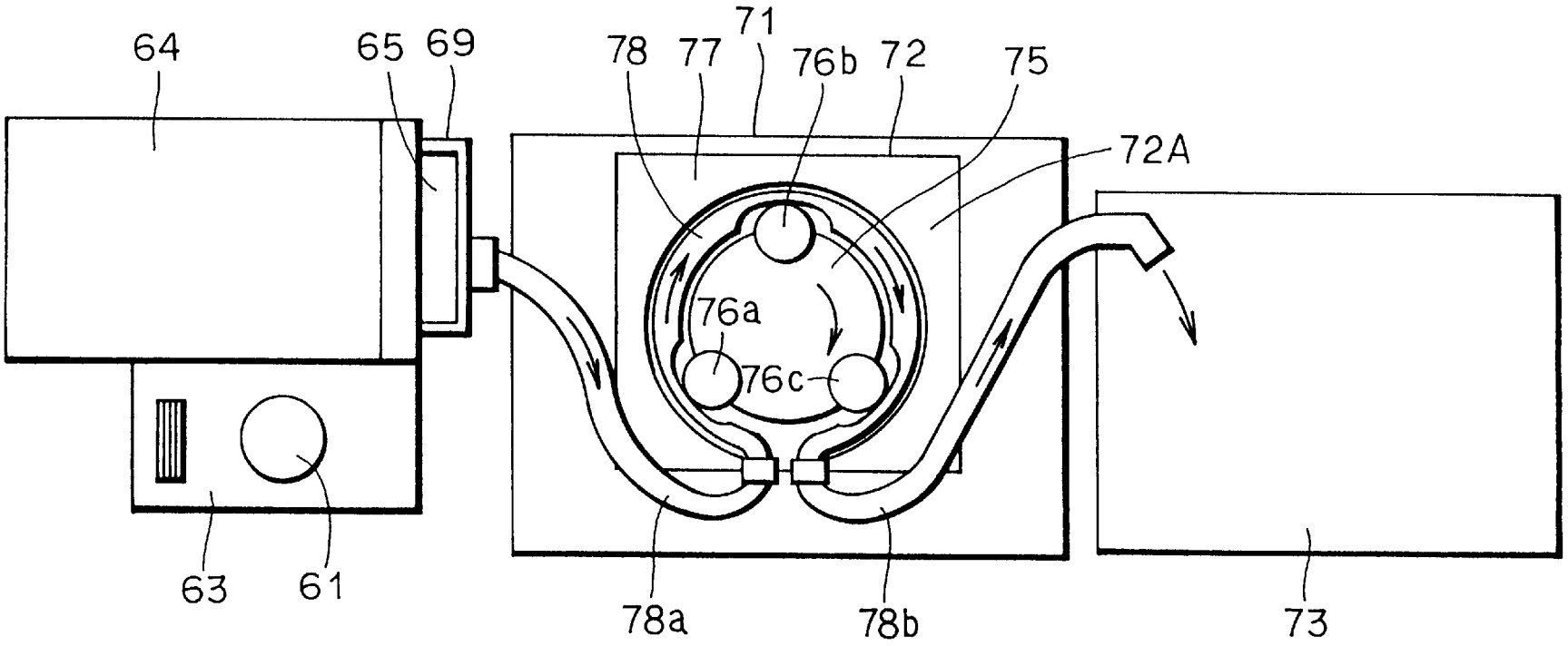
FIG.8 PRIOR ART
FIG. 8 is a schematic view illustrating an internal structure of a conventional suction unit.

As already described with reference to FIG. 8, in this embodiment of FIGS. 4 and 5 also, suction pipe 12 has a plurality of rollers 16*a*, 16*b*, 16*c* attached around rotor 15 which is driven by a motor. Each of rollers 16*a*, 16*b*, 16*c* can rotate about its center as a rotation axis. A tube 18 is provided between rotor 15 and a pump case 17. Tube 18 is compressed by rollers 16*a*, 16*b*, 16*c*. When rotor 15 rotates, those portions of tube 18 which are compressed by rollers 16*a*, 16*b*, 16*c* will be moved to the side of a waste ink tank 13, thereby producing negative pressure on the side of cap 9 so that the ink may be sucked.

For this embodiment, a ring-shaped heating device 19 is provided at one side of pump case 17. A ring-shaped infra-red lamp is embedded in heating device 19 and radiates infra-red rays to rollers 16*a*, 16*b*, 16*c* and tube 18 to heat them. Further, rollers 16*a*, 16*b*, 16*c* heat indirectly those portions of tube 18 which are pressed against by the rollers. For this reason, rollers 16*a*, 16*b*, 16*c* made of a metal having low specific heat are preferable, since such a metal will make shorter the time required for increasing the temperature of rollers 16*a*, 16*b*, 16*c*.

Thus, ring-shaped heating device 19 can heat the tube and rollers without contacting the motor portion. Accordingly, there will not be the possibility that an operation of suction pump 12 will move the heating device and cause disconnection. This enhances the reliability of suction unit 11.

Fourth Embodiment

Figure 6:
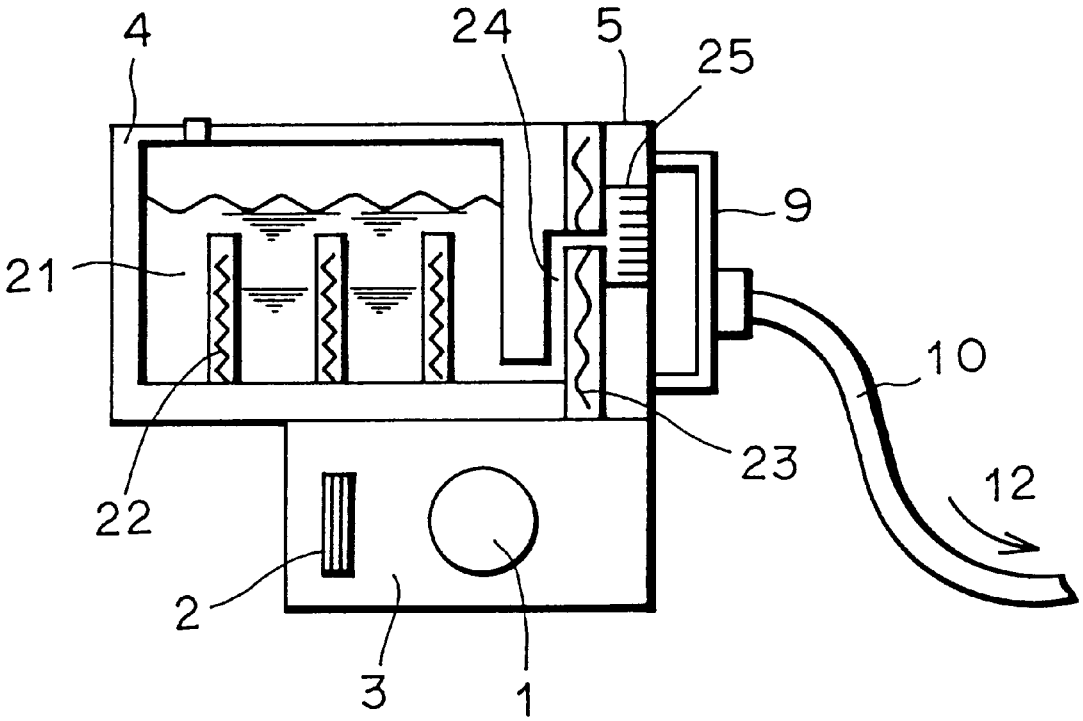
FIG. 6 is a diagram of a fourth embodiment in which the cap member is provided with the heating device.
Figure 7:
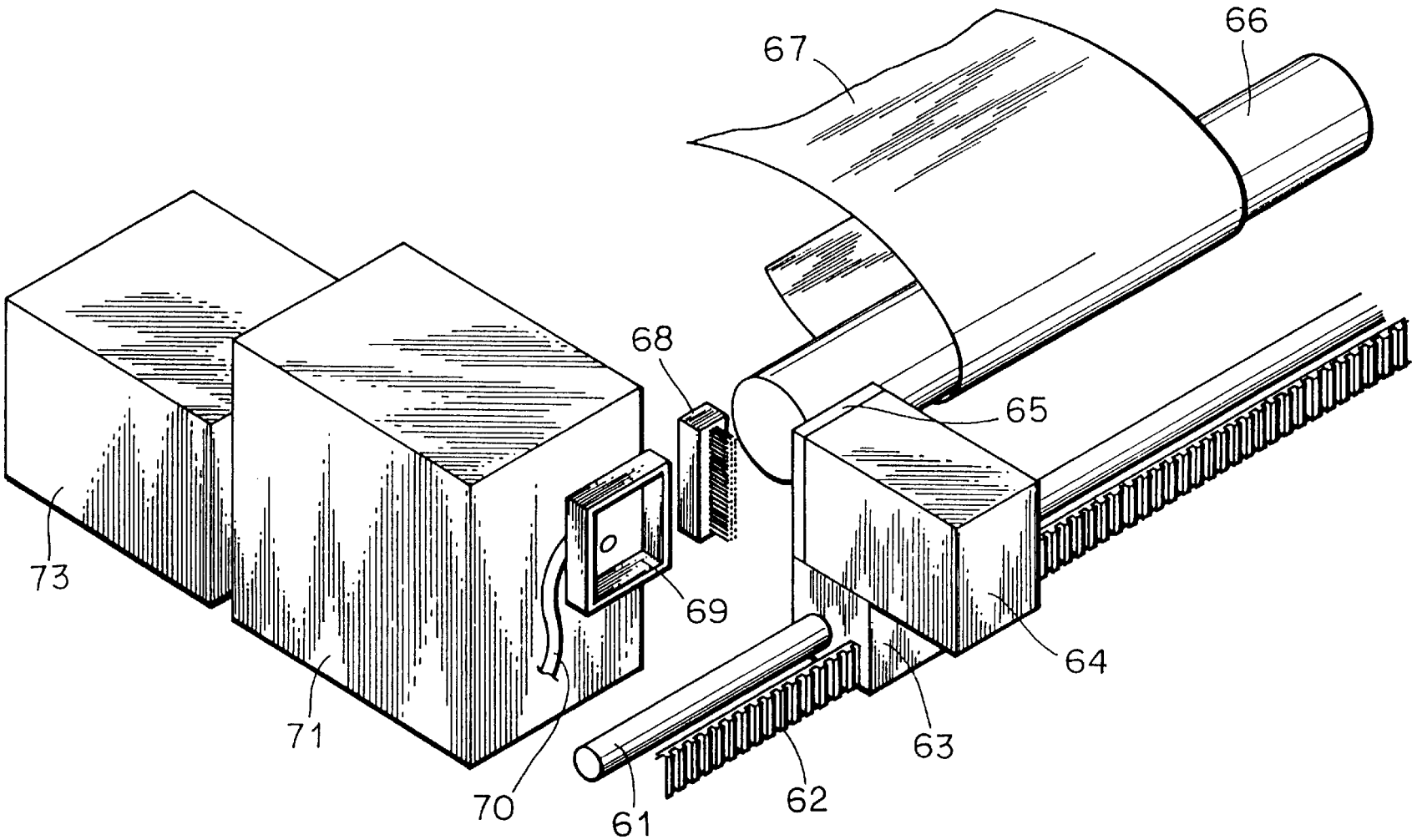
FIG. 7 PRIOR ART
FIG. 7 is a schematic diagram illustrating a structure of a conventional ink jet recording device.

A fourth embodiment in accordance with the present invention will now be described with reference to FIG. 6. In the fourth embodiment, an embodiment in which cap 9 is heated is disclosed. In ink tank 4 held to carriage 3 of the ink jet recording device, a heater 22 is provided for heating and fluidizing heat melting ink or plastic-flowability ink 21. Furthermore, a heater 23 is provided so that heater 23 can heat recording head 5 to maintain the temperature at which the ink can be jetted. Cap 9 is formed of a metal having high heat conductivity such as stainless steel. Accordingly, when cap 9 is fitted to recording head 5, heat from heaters 22 and 23 will be transferred to cap 9 and heat it.

Thus, cap 9 can be heated by using the heaters provided in ink tank 4 and will not necessitate another heat source for it. Therefore, the ink can be prevented from coagulating at the cap portion.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording apparatus for performing recording by using a recording head which includes a jetting portion for jetting ink to a recording medium, comprising:

a cap covering the jetting portion;

a waste ink tank operatively connected to the cap for collecting waste ink from the recording head;

an ink suction pipe joining said cap and said waste ink tank for sucking and draining out the waste ink adhering to said recording head; and means for performing suction connected to said ink suction pipe;

wherein the means for heating the suction pipe is provided with a heater line located within said suction pipe and not within the means for performing suction.

2. The ink jet recording apparatus according to claim 1, wherein said ink suction pipe is made of resin.

* * * * *